US005727766A

United States Patent [19]

Mayo

[11] Patent Number: 5,727,766

[45] Date of Patent: Mar. 17, 1998

[54] DESK PAD

[76] Inventor: Stephen I. Mayo, 721 E. 133rd St., Port Morris, N.Y. 10454-3405

[21] Appl. No.: 563,812

[22] Filed: Nov. 28, 1995

[51] Int. Cl.[6] ..... A47B 91/00

[52] U.S. Cl. ..... 248/346.01; 248/346.03; D19/95; 40/772

[58] Field of Search ..... 248/346.01, 444.1, 248/346.03; 40/768, 771, 772, 774; D19/95; 283/109

[56] References Cited

U.S. PATENT DOCUMENTS

| | | | |
|---|---|---|---|
| 2,308,654 | 1/1943 | Goldstein | D19/95 |
| 3,386,199 | 6/1968 | Nagatsuka | 40/772 |
| 5,386,964 | 2/1995 | Mayo | 248/346.01 |

*Primary Examiner*—Ramon O. Ramirez
*Assistant Examiner*—Willie Berry, Jr.
*Attorney, Agent, or Firm*—Schweitzer Cornman Gross & Bondell LLP

[57] ABSTRACT

A desk pad comprising a) a substantially transparent stiff bendable upper sheet having top and bottom faces and including a linear edge, b) a substantially opaque, porous flexible and slightly elastic lower sheet of substantially the same configuration as the upper sheet, the lower sheet having top and bottom faces and including a linear edge substantially underlying the linear edge of the upper sheet;

c) first and second double faced adhesive tapes of approximately the length of the straight edges, one face of the first tape being secured by its adhesive along the bottom face of the upper sheet parallel to and adjacent the sheet edge, one face of the second tape being secured by its adhesive along the bottom face of the lower sheet parallel to and adjacent its edge, and whereby the upper sheet in its entirety may be pivoted relative to the bottom sheet.

7 Claims, 1 Drawing Sheet

DESK PAD

The application relates to a novel desk pad, simple to manufacture, and simple and reliable to use.

Pads for desks are well known. They protect the desk surface therebelow from the forces of writing, scratching by paper clips, and the like.

It is also known to provide desk pads comprising a desk-protecting lower sheet and a transparent upper sheet connected thereto so that photographs, notes, or other papers, will be in relatively fixed position on the desk, visible through the upper sheet.

Such sheets have been variously connected so as to be separable in whole or in part, for ready access to the space between the sheets to permit changes (additions to or subtractions from) the papers visibly held therebetween.

Such connections have functioned with varying degrees of success. Some are relatively complicated to manufacture. Some provide only limited access to the space between the sheets.

It is accordingly an object of the present invention to provide a novel desk pad which is inexpensive to manufacture but yet provides full access to the space between the sheets.

There and other objects and advantages are realized in accordance with the present invention pursuant to which there is provided a desk pad comprising:

a) a substantially transparent stiff bendable upper sheet having top and bottom faces and including a linear edge, b) a substantially opaque, porous flexible and slightly elastic lower sheet of substantially the same configuration as said upper sheet, said lower sheet having top and bottom faces and including a linear edge substantially underlying the linear edge of said upper sheet;

c) first and second double faced adhesive tapes of approximately the length of said straight edges, one face of the first tape being secured by its adhesive along the bottom face of said upper sheet parallel to and adjacent the sheet edge, one face of the second tape being secured by its adhesive along the bottom face of said lower sheet parallel to and adjacent its edge, and d) a flexible inelastic thin band of approximately the length of said adhesive tapes, said band comprising three longitudinally connected zones, the first and third zones being approximately equal in width to the distance from the edges of the upper and lower sheets to the remote edges of their respective adhesive tapes;

the second longitudinal zone connecting the first and third zones and ranging in width from about 0.3 to 0.6 mm greater than the thickness of said lower sheet;

the top of said first zone being adhesively secured to the tape on the bottom face of said lower sheet, and the bottom of said third zone being adhesively secured to the tape on the bottom face of said upper sheet, whereby the upper sheet in its entirety may be pivoted relative to the bottom sheet with the second zone as an axis.

Advantageously, the upper and lower sheets are substantially rectangular with their corners remote from said edge being rounded, and/or the peripheral area of the top face of said upper sheet is pigmented to form a frame about the balance of said top upper face of said sheet., neither the top nor the bottom sheets being ink receptive on their upper and/or lower faces.

The lower sheet advantageously is about 2 to 4 mm in thickness and comprises comminuted particles of used automotive tires joined to one another, about 20 to 80% of the apparent volume of said lower sheet comprising voids.

The arrangement permits the ready adhesion, and subsequent removal, of a label to the upper face of the lower sheet, useful for shipping, billing and selling.

The pad, so labelled if desired, can then be wrapped, advantageously in transparent plastic so that it can be seen in full by a prospective purchaser.

The invention will now be further described with reference to the accompanying drawings, wherein.

Figure 1:
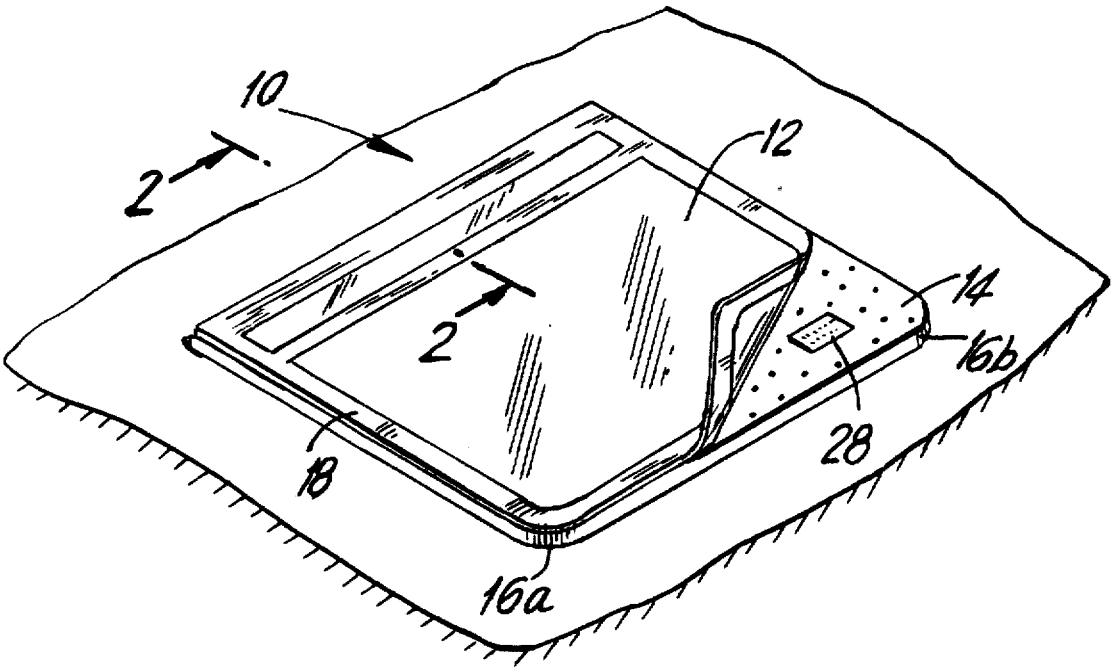
FIG. 1 is a top perspective view of a pad in accordance with the present invention as it would appear on a surface such as a desk top, with the top sheet being partially lifted.

Referring now more particularly to the drawings, in FIG. 1 there is shown a substantially rectangular desk pad 10 comprising an upper sheet 12 and a lower sheet 14, secured to one another at their tops. The upper sheet 12 is transparent, made of a plastic such as polyvinyl chloride, or the like, about 0.1 to 1 mm thick so that, while somewhat stiff, it can readily be bent curvilinearly but will return to its original flat form. The top and bottom faces of the upper sheet are treated so as not to receive ink or pencil, although a Magic Marker pen could leave writing thereon. The lower corners **16*a*, 16*b*** are slightly rounded for the safety of the individual on whose desk the pad will sit.

Around the border of the top face of top sheet 12 is a narrow colored border 18, for decorative purposes so it could serve as a frame for a picture or special paper placed therebelow.

Bottom sheet 14 is of the same configuration as top sheet 12 but is formed of a flexible somewhat elastic material. Preferably it is about 2 to 4 mm in thickness and is formed of comminuted particles of used automotive tires, the particles being held together by a prior heat and/or pressure treatment, solvent treatment, and/or adhesive. Whether so formed or of a cellular material such as foam rubber, cellulose sponge, or the like, advantageously about 20 to 80%, preferably about 35 to 65% and most preferably about 45 to 55% of the apparent volume of the bottom sheet comprises voids, visible from the top or bottom with a magnifying glass. These permit the pad to lie flat on a surface therebelow even if the surface has some small cuts or bumps. In the event a small amount of liquid is unintentionally on the desk top, the pad weight will cause the liquid to be taken up by the bottom sheet 14.

Figure 2:
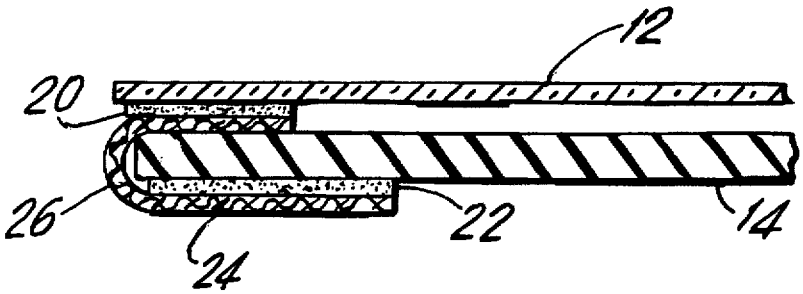
FIG. 2 is a sectional view along line 2—2 of FIG. 1, shown not to scale so as to facilitate comprehension.

FIG. 2 shows the manner of joinder of top sheet 12 to bottom sheet 14, on a magnified scale but not in true proportions. One face of a two faced adhesive tape 20 is secured to the bottom face along the top of top sheet 12 extending to the top or along a line spaced only slightly from the top of top sheet 12.

A similar two faced adhesive tape 22 is adhered in similar fashion to the bottom of bottom sheet 14.

A flexible, preferably inelastic band 24 such as of fabric, plastic, a non-woven sheet, or the like, adheres to the bottoms of tapes 20 and 22. The width of the band is such as to leave an unbonded spine 26, its width exceeding the thickness of bottom sheet 14, e.g. about 2 to 4 mm wider, so it does not interfere with full pivoting of top sheet 12 about its top as an axis.

Figure 3:
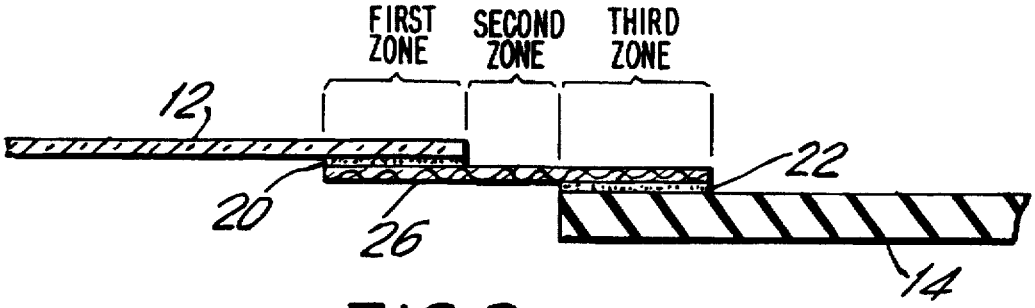
FIG. 3 is a view similar to FIG. 2 but showing the sheets side-by-side rather than overlapping one another for better comprehension of their joinder.

As used herein, the term "pivoting" therefore means the lifting of the unattached edge of sheet 12, as shown in FIG. 2 to the open position, as shown in FIG. 3 whereby the spine 26, which is normally folded when in the closed position (shown in FIG. 2) "pivots" to the open position shown in FIG. 3.

The longitudinal sides of the band 24 along spine 26 in width are approximately equal to the width of the tapes 20 and 22. If narrower, the tapes would adhere undesirably. If too much wider, there would be a hand grip which could facilitate separation, undesired.

In FIG. 1 there is also shown an optional paper label 28 which is temporarily but removably adhered to the top face of the lower sheet 14. The face of the label can bear identifying indicia such as model number, size or price, and will be readily viewable by eye or electronic beam through, and protected by, the transparent top sheet 12.

With the instant construction it is extremely simple to manufacture the desk pads, not requiring any solvents, special adhesives, or the like. The sheets 12 and 14 are pre-cut to the desired shape and size. From a conventional roll of double-faced adhesive tape(s) lengths 20 and 22 are unwound, laid down and cut off, or cut off and then laid down. Then a band for element 24 is cut off from a roll and adhered to the free faces of the tapes 20 and 22, as shown.

Thereafter the desk pad as shown in FIGS. 1 and 2 may be wrapped in plastic or the like.

It will be understood that the specification and examples are illustrative but not limitative of the present invention and that other embodiments within the spirit and scope of the invention will suggest themselves to those skilled in the art.

I claim:

1. A desk pad comprising a) a substantially transparent stiff bendable upper sheet having top and bottom faces and including a linear edge, b) a substantially opaque, porous flexible and slightly elastic lower sheet of substantially the same configuration as said upper sheet, said lower sheet having top and bottom faces and including a linear edge substantially underlying the linear edge of said upper sheet;

c) first and second double faced adhesive tapes of approximately the length of said straight edges, one face of the first tape being secured by its adhesive along the bottom face of said upper sheet parallel to and adjacent the sheet edge, one face of the second tape being secured by its adhesive along the bottom face of said lower sheet parallel to and adjacent its edge, and d) a flexible inelastic thin band of approximately the length of said adhesive tapes, said band comprising three longitudinally connected zones, the first and third zones being approximately equal in width to the distance from the edges of the upper and lower sheets to the remote edges of their respective adhesive tapes;

the second longitudinal zone connecting the first and third zones and ranging in width from about 0.3 to 0.6 mm greater than the thickness of said lower sheet;

the top of said first zone being adhesively secured to the tape on the bottom face of said lower sheet, and the bottom of said third zone being adhesively secured to the tape on the bottom face of said upper sheet, whereby the upper sheet in its entirety may be pivoted relative to the bottom sheet with the second zone as an axis.

2. A pad according to claim 1, wherein the upper and lower sheets are substantially rectangular with their corners remote from said edge being rounded.

3. A pad according to claim 1, wherein the peripheral area of the top face of said upper sheet is pigmented to form a frame about the balance of said top upper face of said sheet.

4. A pad according to claim 1, wherein said lower sheet is from about 2 to 4 mm thick.

5. A pad according to claim 1, wherein said lower sheet comprises comminuted particles of used automotive tires joined to one another, about 20 to 80% of the apparent volume of said lower sheet comprising voids.

6. A pad according to claim 1, wherein the top and bottom faces of said upper sheets are not ink receptive.

7. A pad according to claim 1, including an identifying label removably adhered to the top of said lower sheet so as to be visible through the top sheet.

* * * * *